US011059313B2

(12) United States Patent
Ota et al.

(10) Patent No.: US 11,059,313 B2
(45) Date of Patent: Jul. 13, 2021

(54) SHEET PROCESSING DEVICE AND SHEET MANUFACTURING APPARATUS

(71) Applicant: SEIKO EPSON CORPORATION, Tokyo (JP)

(72) Inventors: Tsukasa Ota, Kofu (JP); Toru Shinohara, Suwa (JP); Jun Takizawa, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 368 days.

(21) Appl. No.: 16/198,946

(22) Filed: Nov. 23, 2018

(65) Prior Publication Data

US 2019/0160847 A1 May 30, 2019

(30) Foreign Application Priority Data

Nov. 24, 2017 (JP) ..... JP2017-226363

(51) Int. Cl.

| | |
|---|---|
| ***B41M 7/00*** | (2006.01) |
| ***G03G 21/00*** | (2006.01) |
| *B41J 11/00* | (2006.01) |
| *B41J 25/00* | (2006.01) |
| *B41J 11/60* | (2006.01) |

(52) U.S. Cl.

CPC ..... *B41M 7/0009* (2013.01); *G03G 21/00* (2013.01); *B41J 11/0015* (2013.01); *B41J 11/60* (2013.01); *B41J 25/00* (2013.01); *B41M 2205/18* (2013.01)

(58) Field of Classification Search

None

See application file for complete search history.

(56) References Cited

U.S. PATENT DOCUMENTS

| | | | | |
|---|---|---|---|---|
| 5,400,123 | A * | 3/1995 | Sato | G03G 9/0926 134/122 P |
| 5,643,380 | A * | 7/1997 | Saitoh | B41J 11/0015 134/15 |
| 6,095,164 | A * | 8/2000 | Saitoh | G03G 21/00 118/500 |
| 6,763,208 | B2 * | 7/2004 | Nagatsuna | G03G 5/00 399/109 |
| 8,389,076 | B2 * | 3/2013 | Murakami | B41M 7/0009 428/32.39 |
| 2002/0003549 | A1 * | 1/2002 | Mitsuhashi | B41M 7/0009 347/2 |
| 2019/0291475 | A1 * | 9/2019 | Ota | B41J 11/007 |

FOREIGN PATENT DOCUMENTS

| | | | |
|---|---|---|---|
| JP | 2014-178514 | A | 9/2014 |
| KR | 200333791 | Y1 * | 11/2003 |

* cited by examiner

*Primary Examiner* — Jill E Culler

(74) *Attorney, Agent, or Firm* — Oliff PLC

(57) ABSTRACT

Provided are a sheet processing device and a sheet manufacturing apparatus capable of removing color material from printed parts without excess or deficiency. A sheet processing device has a detector configured to detect a printed part printed on a sheet; and an eraser configured to selectively remove at least a surface part of a printed area including the printed part detected by the detector. The eraser includes a grinding tool to grind the sheet, and a pressure mechanism configured to selectively increase contact pressure between the sheet and the grinding tool in the printed area.

10 Claims, 12 Drawing Sheets

SHEET PROCESSING DEVICE AND SHEET MANUFACTURING APPARATUS

BACKGROUND

1. Technical Field

The present invention relates to a sheet processing device and a sheet manufacturing apparatus.

2. Related Art

With increased concern about the environment, interest in both reducing consumption of paper and recycling paper has grown. See, for example, JP-A-2014-178514.

JP-A-2014-178514 describes an image erasing device that has a recording medium conveyance mechanism for holding and conveying a recording medium on which an image is recorded, and a recording medium erasing mechanism that is disposed to the recording medium conveyance path and erases the front and back sides of the recording medium to the extent that the image recorded on the recording medium is removed. The recording medium erasing mechanism has erasing members (rollers with a coarse surface) that contact both sides of the recording medium conveyed by the recording medium conveyance mechanism.

However, because the recording medium erasing mechanism described in JP-A-2014-178514 grinds the entire surface of the recording medium, even the white parts of the recording medium where nothing is recorded are also ground. As a result, depending on how much is ground, reusing the recording medium may not be possible.

SUMMARY

An object of the several embodiments of the present invention is to provide a sheet processing device and a sheet manufacturing apparatus capable of removing color material from the printed parts without excess or deficiency.

The present invention is directed to solving at least part of the foregoing problem, and may be embodied as described below.

A sheet processing device according to one aspect of the invention has a detector configured to detect a printed part printed on a sheet; and an eraser configured to selectively remove at least a surface part of a printed area including the printed part detected by the detector.

This configuration enables selectively removing at least the surface part of the printed area. More specifically, while removing the printed area, wasteful removal of material outside the printed area can be prevented. In other words, the printed part can be removed without excess or deficiency.

Preferably in a sheet processing device according to another aspect of the invention, the eraser includes a grinding tool to grind the sheet, and a pressure mechanism configured to selectively increase in the printed area contact pressure between the sheet and the grinding tool.

This configuration enables selectively removing the printed area of the sheet.

Further preferably in a sheet processing device according to another aspect of the invention, the pressure mechanism has a pressure member disposed movably to and away from the grinding tool, and directly or indirectly applies pressure to the sheet from the opposite side of the sheet as the grinding tool.

This configuration enables pressing and grinding the printed area of the sheet against the grinding tool.

In a sheet processing device according to another aspect of the invention, a conveyor is configured to convey the sheet by a conveyor belt at least between the detector and the eraser; and the pressure member presses the sheet to the grinding tool through the conveyor belt.

This configuration can prevent the pressure member applying excessive pressure to the sheet. Unintentionally damaging the sheet can therefore also be prevented.

Further preferably in a sheet processing device according to another aspect of the invention, the pressure member has multiple pressure elements, and selectively drives the pressure elements to increase contact pressure of the grinding tool to the sheet in parts.

This configuration can more reliably prevent grinding parts outside the printed area.

Further preferably in a sheet processing device according to another aspect of the invention, the multiple pressure elements are disposed in a direction intersecting the conveyance direction of the sheet in the eraser.

This configuration can push the printed area to the grinding tool and remove the printed area regardless of where the printed area is located on the sheet.

Further preferably in a sheet processing device according to another aspect of the invention, the pressure elements are rollers or pins.

This configuration enables reducing the size of the pressure elements, and disposing a relatively large greater number of pressure elements. As a result, even relatively small printed areas can be precisely removed.

Further preferably in a sheet processing device according to another aspect of the invention, the pressure member presses and deforms the sheet to protrude in the printed area before the grinding tool grinds the printed area.

This configuration can more effectively prevent grinding parts outside the printed area.

Further preferably, a sheet processing device according to another aspect of the invention also has a controller configured to control operation of the eraser based on a detection result from the detector.

This enables achieving the effect of the invention.

Further preferably in a sheet processing device according to another aspect of the invention, the detector has an imager to image the sheet; and the controller has a data processor configured to process image data captured by the imager.

This configuration enable identifying the printed parts and setting the printed area.

Further preferably in a sheet processing device according to another aspect of the invention, the eraser has a stamping mechanism configured to punch through and remove the printed area of the sheet.

This configuration enables more reliably erasing the printed area.

Another aspect of the invention is a sheet manufacturing apparatus including the sheet processing device according to the invention described above.

This aspect of the invention receives the benefits of the sheet processing device described above while also manufacturing (recycling) sheets.

A sheet manufacturing apparatus according to another aspect of the invention also has a defibrator configured to defibrate a processed sheet of which at least a surface part of the printed area of the sheet was removed by the sheet processing device; and is configured to produce recycled paper using defibrated material acquired by the defibrator.

This aspect of the invention receives the benefits of the sheet processing device described above while also manufacturing (recycling) sheets.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of a sheet processing device and a sheet manufacturing apparatus according to the invention are described below with reference to the accompanying figures.

Embodiment 1

Figure 1:
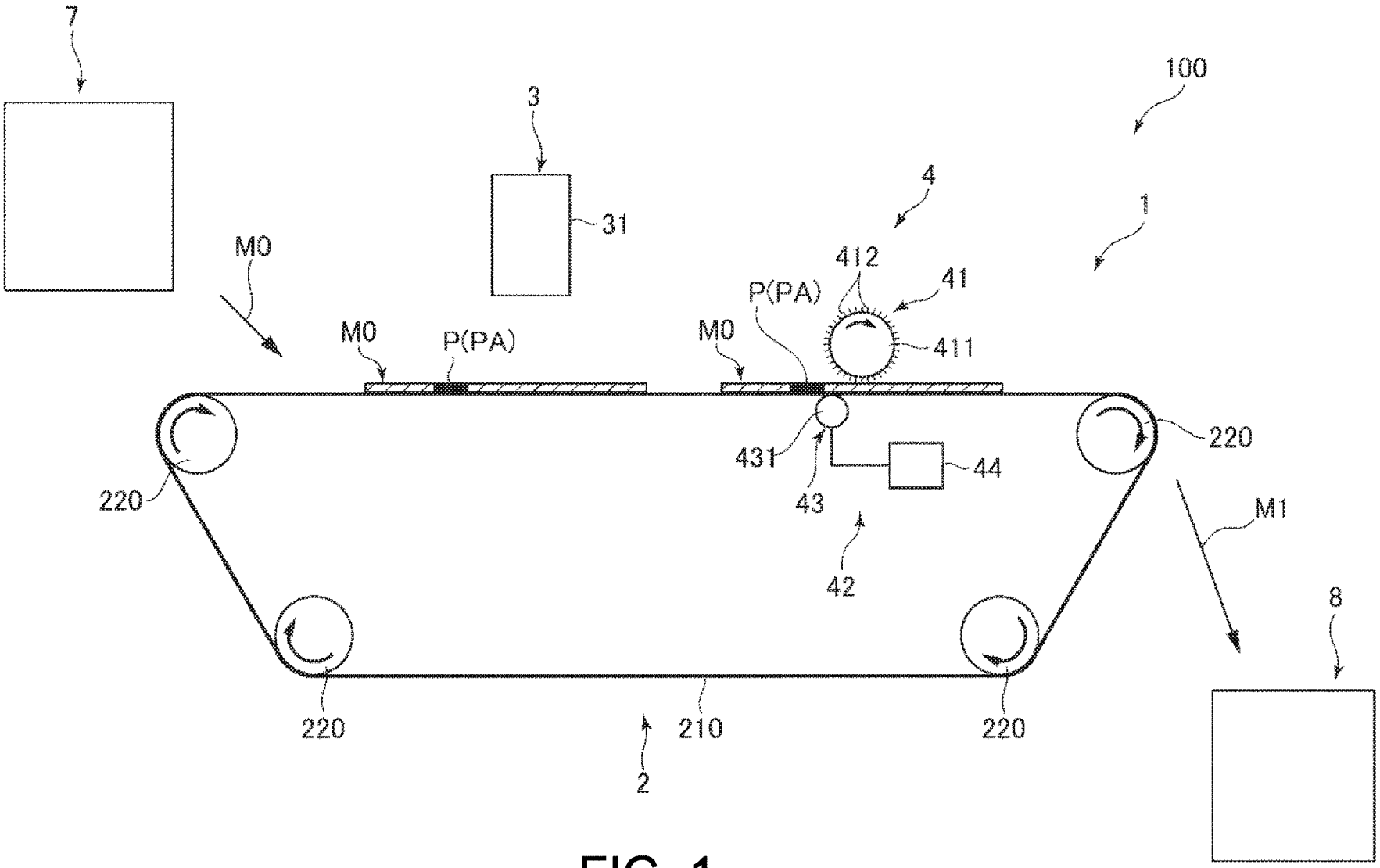
FIG. 1 is a schematic side view illustrating the configuration of a sheet processing device according to the invention disposed to the upstream side of a sheet manufacturing apparatus according to a first embodiment of the invention.
Figure 2:
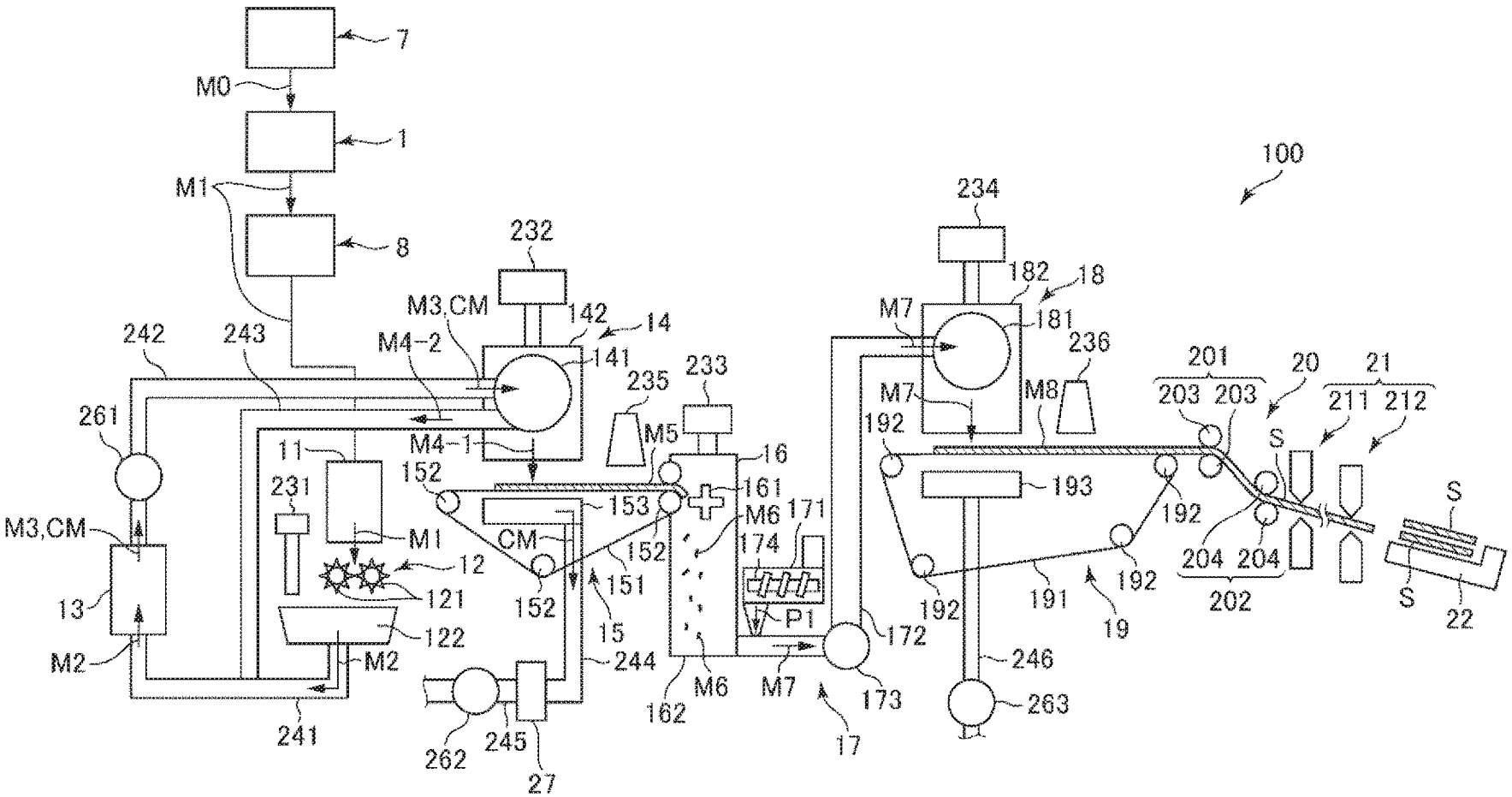
FIG. 2 is a schematic side view illustrating the configuration of the downstream side of a sheet manufacturing apparatus according to the first embodiment of the invention.
Figure 3:
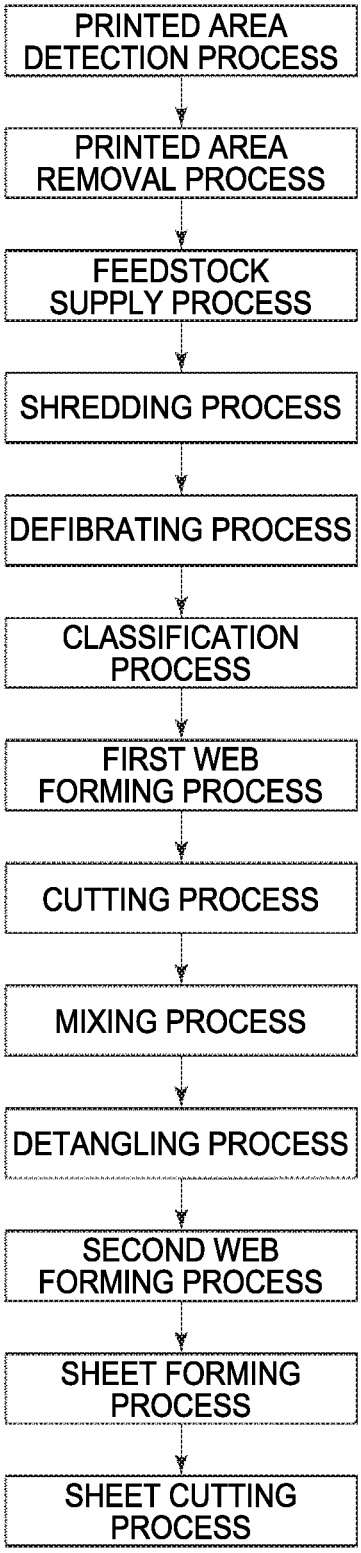
FIG. 3 is a flow chart illustrating processes executed by a sheet manufacturing apparatus according to the first embodiment of the invention.
Figure 4:
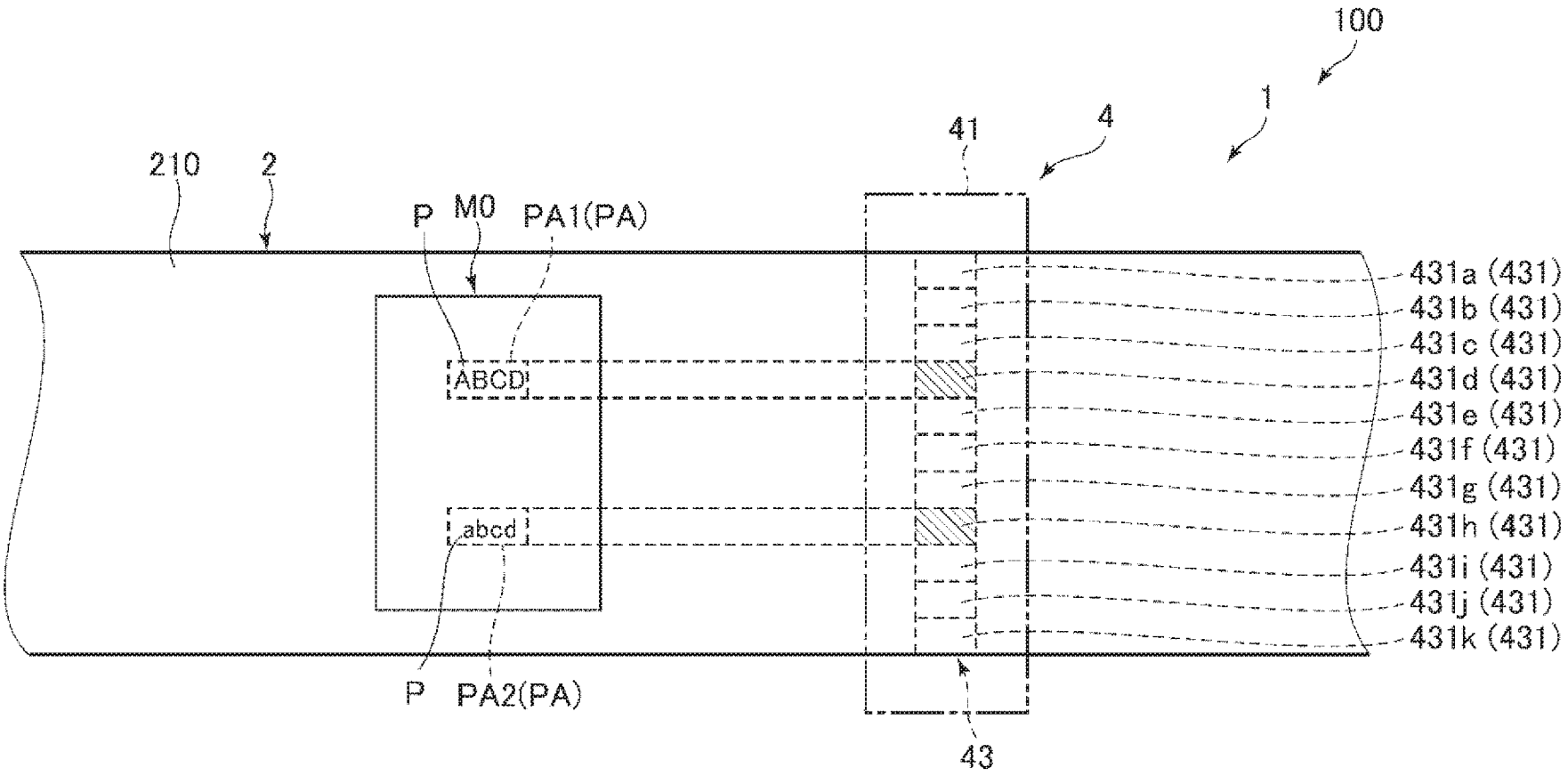
FIG. 4 is a top view of the sheet processing device shown in FIG. 1.
Figure 5:
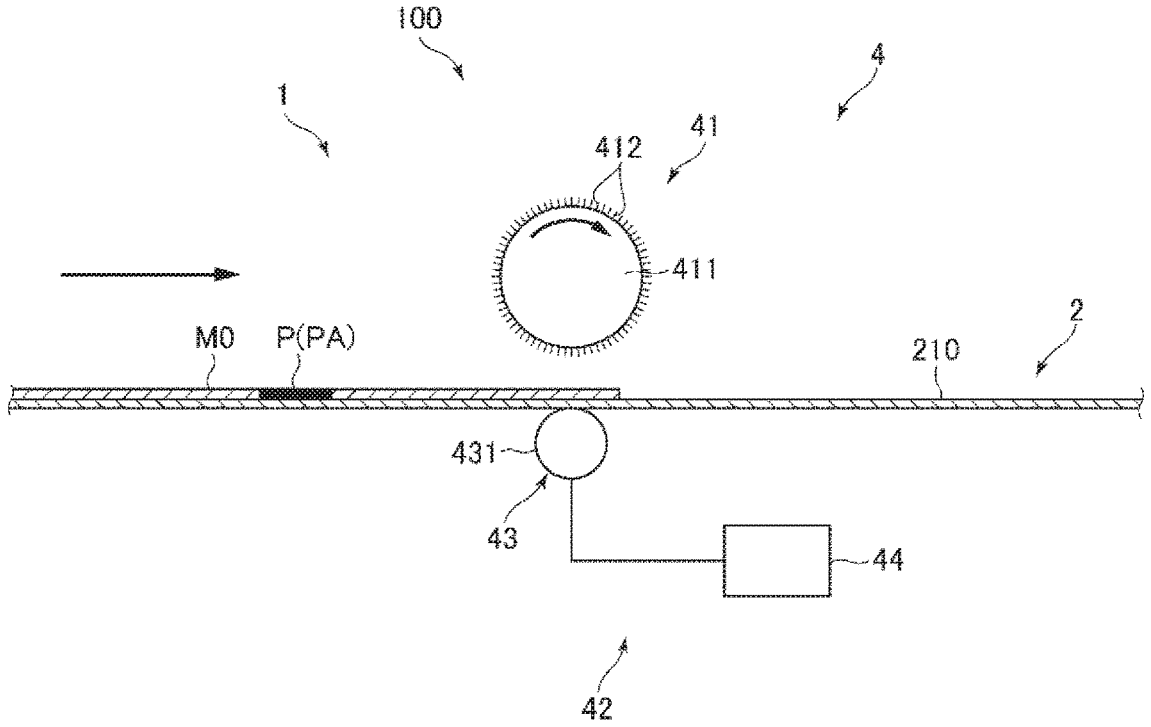
FIG. 5 is a side view of the sheet processing device shown in FIG. 1.
Figure 6:
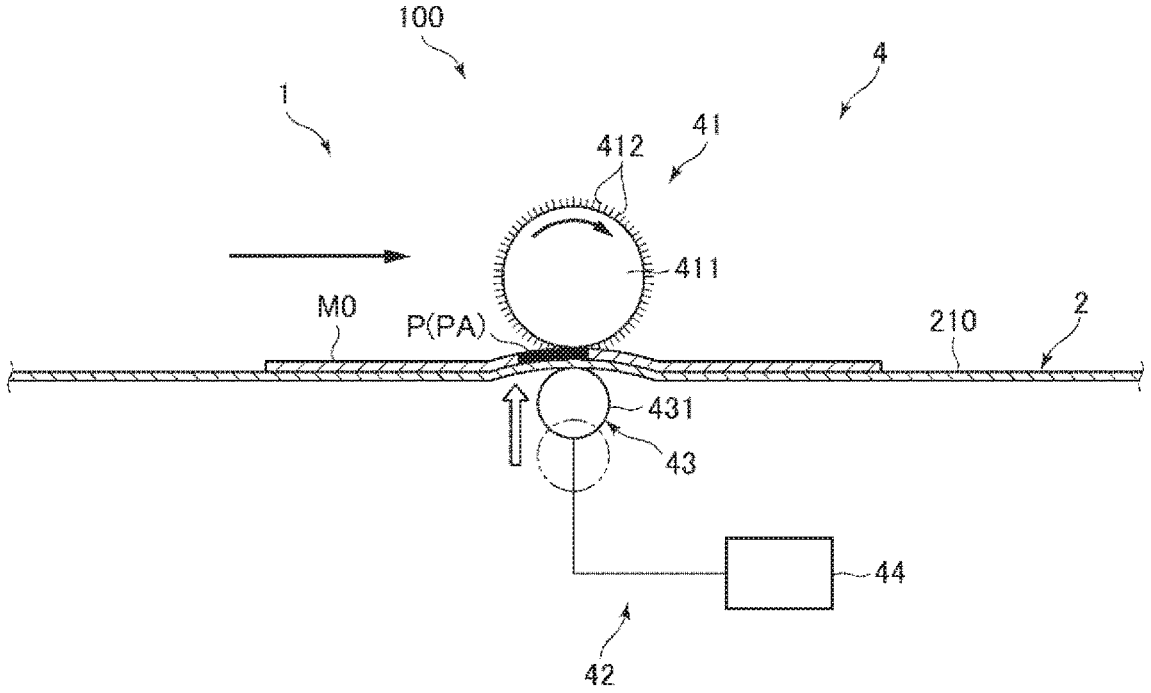
FIG. 6 is a side view of the sheet processing device shown in FIG. 1.
Figure 7:
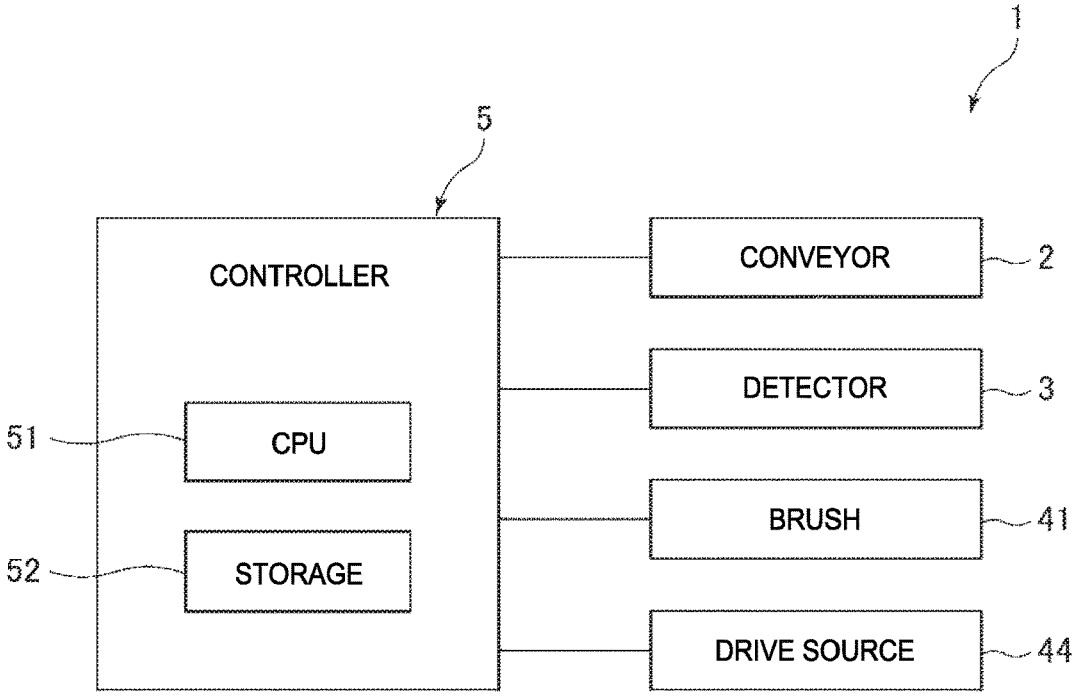
FIG. 7 is a block diagram of the sheet processing device shown in FIG. 1.
Figure 8:
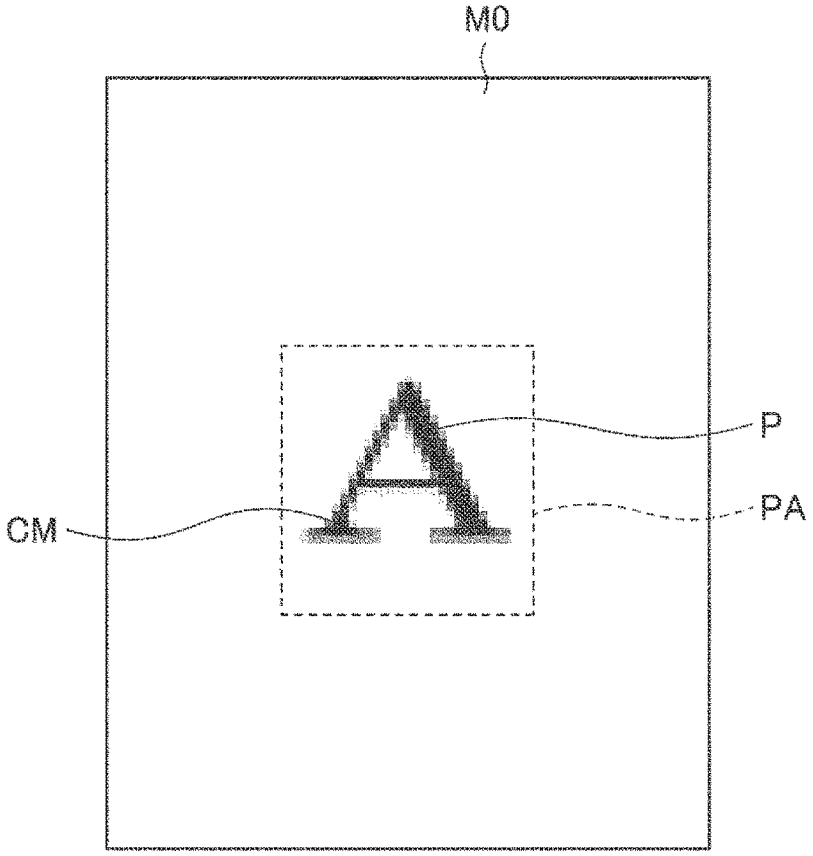
FIG. 8 is a plan view of feedstock supplied to the sheet processing device shown in FIG. 1.
Figure 9:
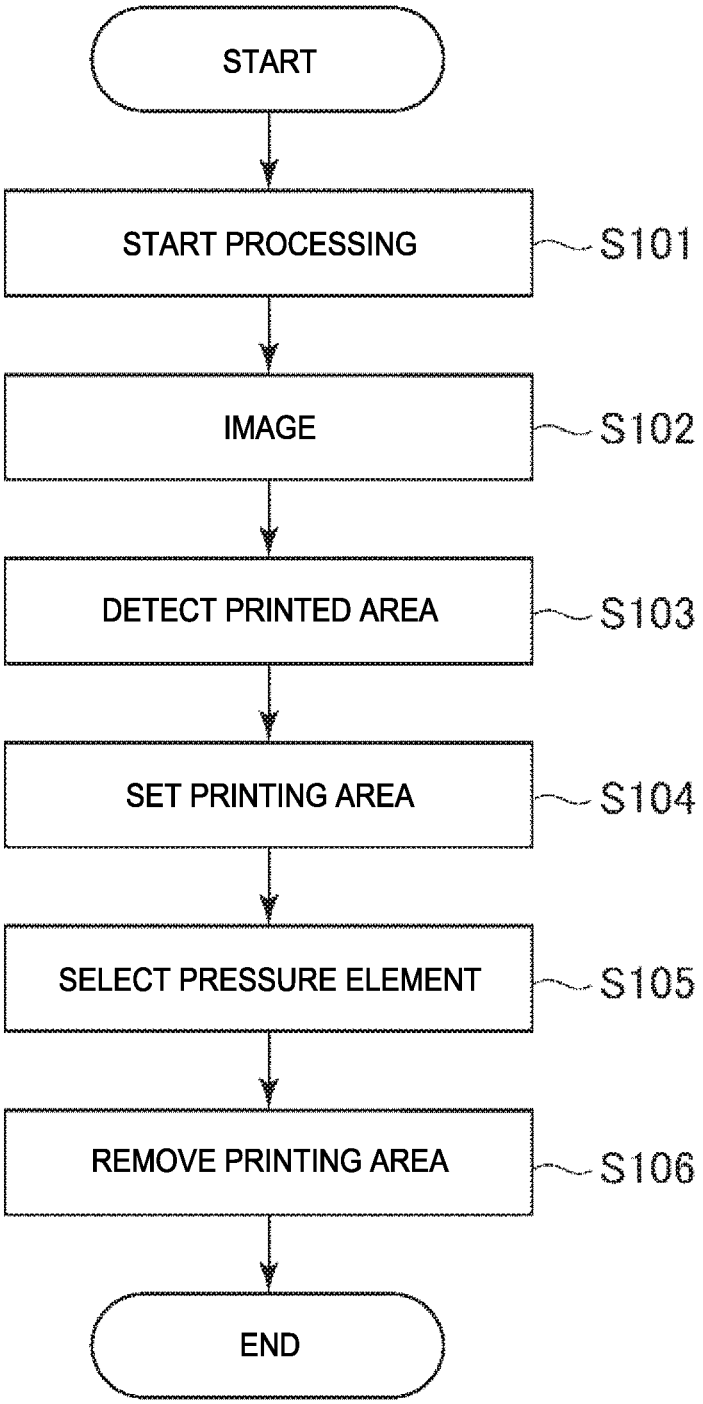
FIG. 9 is a flow chart describing a control operation of the controller shown in FIG. 7.

FIG. 1 is a schematic side view illustrating the configuration of a sheet processing device according to the invention disposed to the upstream side of a sheet manufacturing apparatus according to a first embodiment of the invention. FIG. 2 is a schematic side view illustrating the configuration of the downstream side of a sheet manufacturing apparatus according to the first embodiment of the invention. FIG. 3 is a flow chart illustrating processes executed by a sheet manufacturing apparatus according to the first embodiment of the invention. FIG. 4 is a top view of the sheet processing device shown in FIG. 1. FIG. 5 is a side view of the sheet processing device shown in FIG. 1. FIG. 6 is a side view of the sheet processing device shown in FIG. 1. FIG. 7 is a block diagram of the sheet processing device shown in FIG. 1. FIG. 8 is a plan view of feedstock supplied to the sheet processing device shown in FIG. 1. FIG. 9 is a flow chart describing a control operation of the controller shown in FIG. 7.

Note that for convenience below, the top as seen in FIG. 1 is referred to as the top or above, the bottom as the bottom or below; the left side as the left or upstream side, and the right as the right or downstream side.

The sheet processing device 1 shown in FIG. 1 has a detector 3 for detecting the printed part P printed on the feedstock M0 (sheet), and an eraser 4 for selectively removing the printed area PA including the printed part P detected by the detector 3 on at least the front surface of the feedstock M0.

This enables removing selectively removing the printed area PA on at least the front surface. More specifically, the printed area PA can be selectively (efficiently) removed, and unnecessary removal of parts outside the printed area PA can be prevented. In other words, the printed part P can be removed without excess or deficiency.

The sheet manufacturing apparatus 100 shown in FIG. 2 includes the sheet processing device 1 shown in FIG. 2. More specifically, the sheet manufacturing apparatus 100 has a defibrator 13 that defibrates feedstock M1 (processed sheets) from which the printed area PA on at least the front surface of the feedstock M0 (sheet) has been removed by the sheet processing device 1, and makes sheets S (recycled paper) using the defibrated material M3 produced by the defibrator 13.

The invention thus comprised can therefore receive the benefits of the above sheet processing device 1 when manufacturing (recycling) sheets S. More specifically, because removal of material outside the printed area PA is prevented, as much fiber as possible can be supplied as the feedstock M1 to the downstream side of the sheet manufacturing apparatus 100. Yield is therefore improved, and sheets S with a high degree of whiteness can be formed.

The configuration of parts of the sheet manufacturing apparatus 100 is described next.

The sheet manufacturing apparatus 100 shown in FIG. 1 and FIG. 2 is an apparatus for making (recycling) sheets S (recycled paper) from feedstock M0, and having a first feedstock hopper 7, the sheet processing device 1 according to the invention, a second feedstock hopper 8, a feedstock supply device 11, a shredder 12, a defibrator 13, a classifier 14, a first web forming device 15, a cutter 16, a mixing device 17, a detangler 18, a second web forming device 19, a sheet forming device 20, a paper cutter 21, and a stacker 22. The sheet manufacturing apparatus 100 also has wetting unit 231, wetting unit 232, wetting unit 233, wetting unit 234, wetting unit 235, and wetting unit 236. Operation of parts of the sheet manufacturing apparatus 100 is controlled by a controller not shown.

As shown in FIG. 3, the sheet manufacturing method in this embodiment of the invention includes a printed area detection process, a printed area removal process, a feedstock supply process, a shredding process (refining process), a defibrating process (refining process), a classification process, a first web forming process, a cutting process, a mixing process, a detangling process, a second web forming process, a sheet forming process, and a sheet cutting process. Of these processes, the processes (sheet processing method) executed by the sheet processing device 1 are the printed area detection process and the printed area PA removal process.

As shown in FIG. 1, the first feedstock hopper 7 is the part where feedstock M0, that is, sheets (used sheets) before being processed by the sheet processing device 1, is stocked. The feedstock M0 in this example is fiber-containing material including fiber (particularly cellulosic fiber), and in this example is in a sheet form. In this embodiment, the feedstock M0 is recovered paper, that is, sheets that have been used, but the invention is not so limited and the feedstock M0 may be sheets that have not been used.

Note that the cellulose fiber may be any fibrous material containing mainly cellulose (narrowly defined cellulose) as a chemical compound, and in addition to cellulose (narrowly defined cellulose) may include hemicellulose or lignin.

The sheet processing device 1 according to the invention is disposed on the downstream side of the first feedstock hopper 7. The sheet processing device 1 applies the process described below to the feedstock M0, producing feedstock M1, which is stored in the second feedstock hopper 8. A feedstock supply device 11 is disposed on the downstream side of the second feedstock hopper 8.

The feedstock supply device 11 is the part that executes the feedstock supply process (see FIG. 3) supplying feedstock M1 conveyed from the second feedstock hopper 8 to the shredder 12.

The shredder 12 is the part that executes the shredding process (see FIG. 3) of shredding, in air, the feedstock M1 supplied from the feedstock supply device 11. The shredder 12 has a pair of shredder blades 121 and a chute (hopper) 122.

By turning in opposite directions of rotation, the pair of shredder blades 121 shred the feedstock M1 passing therebetween, that is, cut the feedstock M1 into small shreds M2. The size and shape of the shreds M2 are preferably appropriate to the defibration process of the defibrator 13, and in this example are preferably pieces 100 mm or less on a side, and are further preferably pieces that are greater than or equal to 10 mm and less than or equal to 70 mm per side.

The chute 122 is located below the pair of shredder blades 121, and in this example is funnel-shaped. As a result, the chute 122 can easily catch the shreds M2 that are shredded and dropped by the shredder blades 121.

Above the chute 122, a wetting unit 231 is disposed beside the pair of shredder blades 121. The wetting unit 231 wets the shreds M2 in the chute 122. This wetting unit 231 has a filter (not shown in the figure) containing water, and is configured as a heaterless humidifier (or heated humidifier) that supplies a moist stream of air to the shreds M2 by passing air through the filter. By wet air being supplied to the shreds M2, shreds M2 sticking to the chute 122 due to static electricity can be suppressed.

The chute 122 connects to the defibrator 13 through a conduit (flow channel) 241. The shreds M2 collected in the chute 122 passes through the conduit 241 and are conveyed to the defibrator 13.

The defibrator 13 is the part that executes the defibrating process (refining process) (see FIG. 3) that defibrates the shreds M2 (fiber-containing material including fiber) in a dry process in air. Defibrated material M3 can be produced from the shreds M2 by the defibration process of the defibrator 13.

As used herein, defibrate means to break apart and detangle into single individual fibers shreds M2 composed of many fibers bonded together. The resulting detangled fibers are the defibrated material M3. The shape of the defibrated material M3 is strings and ribbons. The defibrated material M3 may also contain clumps, which are multiple fibers tangled together into clumps.

The defibrator 13 in this embodiment of the invention, for example, is configured as an impeller mill having a rotor that turns at high speed, and a liner disposed around the rotor. Shreds M2 introduced to the defibrator 13 are defibrated between the rotor and the liner.

The defibrator 13, by rotation of the rotor, produces an air flow (current) from the shredder 12 to the classifier 14. As a result, shreds M2 can be suctioned from the conduit 241 to the defibrator 13. In addition, after the defibration process, the defibrated material M3 can be fed through another conduit 242 to the classifier 14.

The defibrator 13 also functions to separate from the fibers materials such as resin particles bonded with the defibrated material M3 (shreds M2), ink, toner, and other color material CM, and bleeding inhibitors.

The defibrator 13 also connects through a conduit 242 (flow path) to the classifier 14. The defibrated material M3 (fiber-containing material after defibration) is conveyed through the conduit 242 to the classifier 14.

A blower 261 is disposed in the conduit 242. The blower 261 is an air flow generator that produces a flow of air to the classifier 14. This promotes conveyance of the defibrated material M3 to the classifier 14.

The classifier 14 executes a process (FIG. 3) of selecting defibrated material M3 based on the length of the fibers. The classifier 14 sorts the defibrated material M3 into first screenings M4-1, and second screenings M4-2 that are larger than the first screenings M4-1. The first screenings M4-1 are a size suitable to making sheets S. The second screenings M4-2 include insufficiently defibrated material, and excessively clumped defibrated fiber.

The classifier 14 includes a drum 141, and a housing 142 enclosing the drum 141.

The drum 141 is a sieve comprising a cylindrical mesh body that rotates on its center axis. The defibrated material M3 flows into the drum 141. As the drum 141 rotates, defibrated material M3 that is smaller than the mesh openings is selected as the first screenings M4-1, and defibrated material M3 that is larger than the mesh openings is selected as the second screenings M4-2.

The first screenings M4-1 drop out from the drum 141.

The second screens M4-2 are discharged to the conduit (flow path) 243 connected to the drum 141. The end of the conduit 243 on the opposite end (downstream end) as the drum 141 is connected to another conduit 241. The second screenings M4-2 passing through conduit 243 merge with the shreds M2 in conduit 241, and flow with the shreds M2 into the defibrator 13. As a result, the second screenings M4-2 are returned to the defibrator 13 and again defibrated with the shreds M2.

The first screenings M4-1 from the drum 141 are dispersed while dropping through air, and descend toward the first web forming device 15 (separator) below the drum 141. The first web forming device 15 is the part that executes a first web forming process (see FIG. 3) forming a first web M5 from the first screenings M4-1.

The first web forming device 15 includes a mesh belt (separation belt) 151, three tension rollers 152, and a suction unit (suction mechanism) 153.

The mesh belt 151 is an endless belt on which the first screened material M4-1 accumulates. This mesh belt 151 is mounted on three tension rollers 152. By rotationally driving the tension rollers 152, the first screened material M4-1 deposited on the mesh belt 151 is conveyed downstream.

The size of the first screened material M4-1 is greater than or equal to the size of the mesh in the mesh belt 151. As a result, passage of the first screened material M4-1 through the mesh belt 151 is limited, and as a result the first screened material M4-1 accumulates on the mesh belt 151.

Furthermore, because the first screened material M4-1 is conveyed downstream by the mesh belt 151 as the first screened material M4-1 accumulates on the mesh belt 151, the first screened material M4-1 is formed in a layer as a first web M5.

Color material CM is removed from the feedstock M1 by the sheet processing device 1, but some color material CM not completely removed by the sheet processing device 1 may remain. Because the color material CM is smaller than the mesh openings of the mesh belt 151, the color material CM passes through the mesh belt 151 and precipitates. This enables removing remnants of color material CM not removed by the sheet processing device 1.

The suction unit 153 suctions air from below the mesh belt 151. As a result, color material CM that has past through the mesh belt 151 can be suctioned together with the air.

The suction unit 153 is connected to a dust collector 27 (collection device) through another conduit (flow path) 244. Color material CM suctioned by the suction unit 153 are captured by the dust collector 27.

Another conduit (flow path) 245 is also connected to the dust collector 27. A blower 262 is disposed to the conduit 245. Operation of the blower 262 produces suction in the suction unit 153. This promotes formation of the first web M5 on the mesh belt 151. The first web M5 is made from material from which color material CM has been removed. Operation of the blower 262 causes the color material CM to pass through the conduit 244 and reach the dust collector 27.

The housing 142 is connected to a wetting unit 232. Like the wetting unit 231 described above, the wetting unit 232 is a heaterless humidifier. As a result, wet air is supplied into the housing 142. This wet air moistens the first screened material M4-1, and as a result can suppress sticking of the first screened material M4-1 to the inside walls of the housing 142 due to static electricity.

Another wetting unit 235 is disposed downstream from the classifier 14. This wetting unit 235 is configured as an ultrasonic humidifier that mists water. As a result, moisture can be supplied to (can humidify or moisten) the first web M5, and the moisture content of the first web M5 can thereby be adjusted. This adjustment can also suppress sticking of the first web M5 to the mesh belt 151 due to static electricity. As a result, the first web M5 easily separates from the mesh belt 151 at the tension roller 152 from where the mesh belt 151 returns to the upstream side.

On the downstream side of the wetting unit 235 is a cutter 16. The cutter 16 is a part that executes a cutting process (see FIG. 3) of cutting the first web M5 that has separated from the mesh belt 151.

The cutter 16 has a propeller 161 that is rotationally supported, and a housing 162 that houses the propeller 161. The first web M5 is cut into pieces by the first web M5 being fed into the rotating propeller 161. The cut first web M5 forms segments M6. The segments M6 then drop down in the housing 162.

The housing 162 is connected to another wetting unit 233. Like the wetting unit 231 described above, the wetting unit 233 is a heaterless humidifier. As a result, wet air is supplied into the housing 162. This wet air suppresses sticking of the segments M6 to the propeller 161 and to the inside walls of the housing 162 due to static electricity.

A mixing device 17 is disposed on the downstream side of the cutter 16. The mixing device 17 is the part that executes a mixing process (see FIG. 3) of mixing the segments M6 with resin P1. The mixing device 17 includes a resin supply device 171, a conduit (flow path) 172, and a blower 173.

The conduit 172 connects to the housing 162 of the cutter 16 and the housing 182 of the detangler 18, and is a flow path through which a mixture M7 of the segments M6 and resin P1 passes.

The resin supply device 171 connects to the conduit 172. The resin supply device 171 has a screw feeder 174. By rotationally driving the screw feeder 174, the resin P1 can be supplied in powder or particle form to the conduit 172. The resin P1 supplied to the conduit 172 is mixed with the segments M6, forming the mixture M7.

Note that the resin P1 bonds fibers together in a downstream process, and may be a thermoplastic resin or a thermosetting resin, but is preferably a thermoplastic resin. Examples of such thermoplastic resins include AS resin, ABS resin, polyethylene, polypropylene, ethylene-vinylacetate copolymer (EVA), or other polyolefin, denatured polyolefins, polymethylmethacrylate or other acrylic resin, polyvinyl chloride, polystyrene, polyethylene terephthalate, polybutylene terephthalate or other polyesters, nylon 6, nylon 46, nylon 66, nylon 610, nylon 612, nylon 11, nylon 12, nylon 6-12, nylon 6-66 or other polyimide (nylon), polyphenylene ether, polyacetal, polyether, polyphenylene oxide, polyether ether ketone, polycarbonate, polyphenylene sulfide, thermoplastic polyimide, polyether imide, aromatic polyester, or other liquid crystal polymer, styrenes, polyolefins, polyvinyl chlorides, polyurethanes, polyesters, polyimides, polybutadienes, transpolyisoprenes, fluoroelastomers, polyethylene chlorides and other thermoplastic elastomers, as well as combinations of one or two or more of the foregoing. Preferably, a polyester or resin containing a polyester is used as the thermoplastic resin.

Additives other than resin P1 may also be supplied from the resin supply device 171, including, for example, coloring agents for adding color to the fiber, anti-blocking agents for suppressing clumping of the fiber and clumping of the resin P1, and flame retardants for making the fiber and manufactured sheets difficult to burn. Starch and other vegetable materials may also be used.

The blower 173 is disposed to the conduit 172 downstream from the resin supply device 171. The blower 173 is configured to produce an air current toward the detangler 18. This air current can also mix the segments M6 and resin P1 inside the conduit 172. As a result, the mixture M7 can be introduced to the detangler 18 as a uniform dispersion of the segments M6 and resin P1. The segments M6 in the mixture M7 are further detangled into smaller fibers while travelling through the conduit 172.

The detangler 18 is the part that executes the detangling process (see FIG. 3) that detangles interlocked fibers in the mixture M7.

The detangler 18 includes a drum 181 and a housing 182 that houses the drum 181.

The drum 181 is a sieve comprising a cylindrical mesh body that rotates on its center axis. The mixture M7 is introduced to the drum 181. By the drum 181 rotating, fiber in the mixture M7 that is smaller than the mesh can pass through the drum 181. The mixture M7 is detangled in this process.

The mixture M7 that is detangled in the drum 181 is dispersed while dropping through air, and falls to the second web forming device 19 located below the drum 181. The second web forming device 19 is the part that executes the second web forming process (see FIG. 3) forming a second web M8 from the mixture M7. The second web forming device 19 includes a mesh belt 191 (separation belt), tension rollers 192, and a suction unit 193 (suction mechanism).

The mesh belt 191 is an endless belt on which the mixture M7 accumulates. This mesh belt 191 is mounted on four tension rollers 192. By rotationally driving the tension rollers 192, the mixture M7 deposited on the mesh belt 191 is conveyed downstream.

Most of the mixture M7 on the mesh belt 191 is larger than the mesh in the mesh belt 191. As a result, the mixture M7 is suppressed from passing through the mesh belt 191, and therefore accumulates on the mesh belt 191. The mixture M7 is conveyed downstream by the mesh belt 191 as the mixture M7 accumulates on the mesh belt 191, and is formed in a layer as the second web M8.

The suction unit 193 suctions air down from below the mesh belt 191. As a result, the mixture M7 can be pulled onto the mesh belt 191, and accumulation of the mixture M7 on the mesh belt 191 is thereby promoted.

Another conduit 246 (flow path) is connected to the suction unit 193. A blower 263 is also disposed to the conduit 246. Operation of the blower 263 produces suction in the suction unit 193.

Another wetting unit 234 is connected to the housing 182. Like the wetting unit 231 described above, the wetting unit 234 is a heaterless humidifier. As a result, wet air is supplied into the housing 182. By humidifying the inside of the housing 182 by adding wet air, sticking of the mixture M7 to the inside walls of the housing 182 due to static electricity can be suppressed.

Another wetting unit 236 is disposed below the detangler 18. This wetting unit 236 is configured as an ultrasonic humidifier similarly to the wetting unit 235 described above. As a result, moisture can be supplied to the second web M8, and the moisture content of the second web M8 can thereby be adjusted. This adjustment can also suppress sticking of the second web M8 to the mesh belt 191 due to static electricity. As a result, the second web M8 easily separates from the mesh belt 191 at the tension roller 192 from where the mesh belt 191 returns to the upstream side.

A sheet forming device 20 is disposed downstream from the second web forming device 19. The sheet forming device 20 is the part that executes the sheet forming process (see FIG. 3) forming sheets S from the second web M8. This sheet forming device 20 includes a calender 201 and a heater 202.

The calender 201 comprises a pair of calender rolls 203, and compresses the second web M8 between the calender rolls 203 without heating the second web M8. This process increases the density of the second web M8. The second web M8 is then conveyed toward the heater 202. Note that one of the pair of calender rolls 203 is a drive roller that is driven by operation of a motor (not shown in the figure), and the other is a driven roller.

The heater 202 has a pair of heat rollers 204, which can heat while compressing the second web M8 between the heat rollers 204. The combination of heat and pressure melts the resin P1 in the second web M8, and binds fibers through the molten resin P1. As a result, a sheet S is formed.

The sheet S is then conveyed to the paper cutter 21. Note that one of the pair of heat rollers 204 is a drive roller that is driven by operation of a motor (not shown in the figure), and the other is a driven roller.

A paper cutter 21 is disposed downstream from the sheet forming device 20. The paper cutter 21 is the part that executes the sheet cutting process (see FIG. 3) that cuts the continuous sheet S into single sheets S. The paper cutter 21 includes a first cutter 211 and a second cutter 212.

The first cutter 211 cuts the sheet S in the direction crosswise to the conveyance direction of the sheet S.

The second cutter 212 is downstream from the first cutter 211, and cuts the sheets S in the direction parallel to the conveyance direction of the sheet S.

Sheets S of a desired size are produced by the cutting action of the first cutter 211 and the second cutter 212. The sheets S are then conveyed further downstream and stacked in a stacker 22.

A sheet processing device 1 according to the invention is described next.

The sheet processing device 1 shown in FIG. 1 is disposed on the upstream side of the sheet manufacturing apparatus 100, and is a device that removes color material CM in the printed part P of the feedstock M0 described above.

The sheet processing device 1 has a conveyor 2, detector 3, and eraser 4, which are unitized in a housing not shown.

The sheet processing device 1 is an apparatus that sequentially executes a printed area detection process, refining prevention agent application process, and drying process.

Note that the sheet processing device 1 may be disposed or connected to the feedstock supply device 11 (see FIG. 2) through the second feedstock hopper 8. This enables processing sheets in the sheet process and manufacturing new sheets in the sheet recycling process in a single continuous operation.

Parts of the sheet processing device 1 are described next.

The conveyor 2 conveys preprocessed feedstock M0 supplied from the first feedstock hopper 7 downstream. The conveyor 2 includes a glue belt 210 (endless belt) used as a conveyor belt, and four tension rollers 220 with the glue belt 210 mounted around the tension rollers 220. At least one tension roller 220 has an internal motor, which drives and turns when energized. As a result, the feedstock M0 on the glue belt 210 can be conveyed downstream (in the direction of the arrow in FIG. 1).

The surface of the glue belt 210 is preferably adhesive. This enables stable conveyance of the feedstock M0, and stable execution of the printed area detection process and printed area removal process. Tension is applied to the feedstock M0 during grinding in the printed area removal process described below, and using glue belt 210 can prevent the feedstock M0 from shifting position due to grinding. Variation in the timing of the grinding step as a result of the position shifting can therefore be prevented.

Note that the same effect can be achieved when the glue belt 210 does not have an adhesive surface by providing a suction mechanism that pulls the feedstock M0 to the glue belt 210 by suction through the glue belt 210.

Multiple sheets of feedstock M0 can also be carried on the glue belt 210 at one time. The orientation (positioning) of each sheet of feedstock M0 on the glue belt 210 may also be aligned (the same) or not.

Note that the conveyor 2 configuration shown in FIG. 1 is a belt conveyor, but the invention is not so limited and may be a configuration that conveys while holding the feedstock M0 by negative pressure suction on a stage, that is, a configuration that has a platen and multiple conveyance rollers.

The detector 3 executes the printed area detection process for detecting the printed part P of the feedstock M0, and in this example has a camera 31 (imaging device) such as a CCD camera. The camera 31 is disposed separated from one side of the glue belt 210, that is, above the top side of the glue belt 210 in this example. The camera 31 images the feedstock M0 conveyed on the glue belt 210.

In this example the feedstock M0 is recovered paper, that is, used paper that has been printed or written on over the greater part. As a result, text, images, or other content has been printed on the feedstock M0 by applying black or color toner or ink, dyes, pigments, or other color material CM to the feedstock M0. Herein, the part of the feedstock M0 where color material CM is present is referred to as the printed part P. The printed part P is not limited to text, and may include symbols, graphics and images, or simply a soiled or smudged area.

The camera 31 is electrically connected to the controller 5, and its operation is controlled by the controller 5. Image data captured by the camera 31 is sent to the controller 5.

Note that the detector 3 is a camera that captures a two-dimensional image in the configuration shown in FIG. 1, but the invention is not so limited, and may be a one-dimensional line sensor or scanner, for example. In this case, the detector 3 may be a reflective or transmissive detector.

The eraser 4 has a grinding tool for grinding the feedstock M0 (sheet), and a pressure mechanism 42 for selectively increasing the contact pressure between the feedstock M0 (sheet) and brush 41 (grinding tool) in the printed area PA. As a result, the printed area PA of the feedstock M0 can be selectively abraded as described below.

As shown in FIG. 8, the printed area PA is a part of the feedstock M0 containing at least the printed part P and some surrounding white space (margin), and may be rectangular, square, round, oval, or other shape, but in the configuration shown in the figure is rectangular. Note that the printed area PA may not include white space. In addition, if the printed part P is a line (row or column) of text, the printed area PA may be the area containing that line (row or column). This printed area PA is set by the controller 5 as described below.

The brush 41 includes a core 411 and bristles 412.

The core 411 is connected to a motor (not shown in the figure), and the bristles 412 turn in the direction of the arrow when the motor is driven. The axis of rotation of the brush 41 is disposed substantially perpendicular to the conveyance direction of the feedstock M1. However, the invention is not so limited, and the axis of rotation may be disposed inclined a specific angle (such as greater than or equal to 5 degrees and less than or equal to 45 degrees) to the direction perpendicular to the axis of rotation.

Bristles 412 are implanted to the entire outside surface of the core 411. The bristles 412 are made from a pliable resin material such as polyimide or polyester. The tips of the bristles 412 may be sharp or rounded.

This embodiment describes an example in which the grinding tool is a brush, but the invention is not so limited and the grinding tool may be a whetstone or file, for example.

When the brush 41 turns in the direction of the arrow in the figure while in contact with the sheet S, the sheet S is abraded (ground). Note that the brush 41 may be configured to turn in the opposite direction as shown in the figure, or to periodically alternate between clockwise and counterclockwise rotation. The brush 41 may also be configured to move (bidirectionally) in the same direction as the direction of rotation as the brush 41 turns.

The pressure mechanism 42 includes a roller group 43 as pressure members, and a drive source 44 that drives the rollers of the roller group 43 independently.

As shown in FIG. 4, the roller group 43 is disposed to a position opposite the brush 41 with the glue belt 210 therebetween, and its position in the conveyance direction of the feedstock M0 is the same as the brush 41. The roller group 43 includes multiple (11 in the configuration shown in the figure) short rollers 431.

The short rollers 431 have a cylindrical outside shape, and are disposed with the axis of rotation substantially perpendicular to the conveyance direction of the feedstock M1. The short rollers 431 are disposed substantially coaxially in a line across the width of the glue belt 210.

Each of the short rollers 431 is configured movably to and away from the brush 41. The short rollers 431 intermittently apply pressure through the glue belt 210 to the opposite side of the feedstock M0 as the brush 41 (the bottom side as seen in FIG. 1, FIG. 5, and FIG. 6).

The pressure mechanism 42 thus has a roller group 43 (pressure members) disposed movably to and away from the brush 41 (grinding tool), and directly or indirectly (indirectly in this embodiment) applies pressure to the feedstock M0 (sheet) from the opposite side of the feedstock M0 (sheet) as the brush 41 (grinding tool). As a result, the printed area PA of the feedstock M0 can be pushed against the brush 41 and ground.

The sheet processing device 1 also has a conveyor 2 that conveys the feedstock M0 (sheet) by means of a glue belt 210 (conveyor belt) at least between the detector 3 and eraser 4, and the roller group 43 (pressure member) pushes the feedstock M0 (sheet) through the glue belt 210 (convey belt) against the brush 41 (grinding tool). The roller group 43 applying excessive pressure to the feedstock M0 can therefore be prevented. As a result, unintentionally damaging the magneto-optical can be prevented.

The plural short rollers 431 (pressure elements) are disposed across the width of the glue belt 210, that is, in a direction intersecting the conveyance direction of the feedstock M0 (sheet) in the eraser 4. As a result, as described below, pressure can be applied to the printed area PA regardless of where on the feedstock M0 the printed area PA is located. This means that the printed area PA can be removed by pushing the brush 41 against the printed area PA regardless of where on the feedstock M0 the printed area PA is located.

Furthermore, the size of the pressure elements can be reduced and a relatively large number of pressure elements can be provided by using rollers or pins (short rollers 431 in this embodiment). As a result, even relatively small printed areas PA can be precisely ground and removed.

The short rollers 431 may be configured to rotate or no rotate.

The drive source 44 can move the short rollers 431 independently up and down, that is, to and away from the brush 41. Insofar as this ability is provided, the configuration of the drive source 44 is not specifically limited, and the drive source 44 may be configured with multiple drive elements such as air cylinders or solenoids connected to the individual short rollers 431. The drive source 44 can be electrically connected to the controller 5 and operation controlled by energizing the drive elements.

As shown in FIG. 5, until the feedstock M0 is conveyed to the eraser 4 in the sheet processing device 1, the glue belt 210 and brush 41 are separated. When an area outside the printed area PA of the feedstock M0 (that is, white space) passes between the brush 41 and short rollers 431, the short rollers 431 do not operate. Timed to when the printed area PA of the feedstock M0 passes between the brush 41 and short rollers 431, one or more short rollers 431 move to the brush 41, and push the glue belt 210 and feedstock M1 up, causing the printed area PA to contact the brush 41.

As a result, contact pressure between brush 41 and the printed area PA of the feedstock M0 increases, the surface part of the printed area PA is abraded, and the printed part P, that is, the color material CM, is removed from the feedstock M0 without excess or deficiency. Specifically, because grinding of areas outside the printed area PA is prevented, the amount of fiber supplied as feedstock M1 to the downstream sheet manufacturing apparatus 100 can be increased as much as possible. Yield is therefore good and sheets S with a high degree of whiteness can be produced.

Note that the surface part as referred to herein means the portion to a depth of 1/10 to 1/2 of the thickness from the surface. While the whiteness of the manufactured sheets S can be improved by removing at least the surface part of the printed area PA, grinding to a greater depth from the surface part is preferable when the color material CM has penetrated to a greater depth or the color material CM is relatively dark. Depending on the degree of color material CM penetration and the color of the color material CM, the feedstock M1 may be ground until through-holes are formed. The depth of color material CM penetration can be estimated from the type of color material CM, the type of fiber in the feedstock M0, the density, and other factors. If this information is already known, the contact pressure of the short rollers 431 and brush 41 is desirably adjusted.

In the example in FIG. 4, when there are two printed parts P on the feedstock M0 and two printed areas PA are set, the printed areas PA are removed as described below. These two printed areas PA are identified from the upstream side in FIG. 4 as printed area PA1 and printed area PA2. The eleven short rollers 431 are identified from the upstream side in FIG. 4 as short roller 431*a*, short roller 431*b*, short roller 431*c*, short roller 431*d*, short roller 431*e*, short roller 431*f*, short roller 431*g*, short roller 431*h*, short roller 431*i*, short roller 431*j*, short roller 431*k*.

In the example in FIG. 4A, short roller 431*d* corresponding to printed area PA1, that is, at the same position in the direction perpendicular to the glue belt 210, and short roller 431*h* corresponding to printed area PA2, that is, at the same position in the direction perpendicular to the glue belt 210, operate, and the other short rollers 431 do not operate. More specifically, only short roller 431*d* and short roller 431*h* located at the positions capable of grinding printed area PA1 and printed area PA2 push the feedstock M0 against the brush 41.

The roller group 43 (pressure member) thus has multiple short rollers 431 (pressure elements), and selectively drives the short rollers 431 (pressure elements) to increase the contact pressure of the brush 41 (grinding tool) on specific parts of the feedstock M0 (sheet). Grinding parts outside the printed area PA can therefore be more reliably prevented, and the amount of fiber supplied as feedstock M1 to the sheet manufacturing apparatus 100 downstream can be further increased. Sheets S can therefore be manufactured with good yield.

The glue belt 210 and brush 41 are separated until the feedstock M0 is conveyed to the eraser 4 in this configuration, but the invention is not so limited and the glue belt 210 and brush 41 may be in contact.

The brush 41 in this embodiment is configured to rotate even when not grinding the feedstock M0, but the invention is not so limited, and may be configured to turn only when grinding the feedstock M0, that is, so the short rollers 431 turn only when the feedstock M0 is pushed up.

As shown in FIG. 4, the controller 5 includes a CPU 51 (processor) and storage 52 (memory, hard disk drive, for example), and controls operation of the conveyor 2, detector 3, and eraser 4. The controller 5 controls operation of the eraser 4 based on output from the detector 3. This enables achieving the effects described above.

The controller 5 in this embodiment may be disposed where desired in the sheet processing device 1, or it may be an externally connected control device. In configured as an external device, the control device and sheet manufacturing apparatus may communicate wirelessly or by wire, or through the Internet, for example. In addition, a configuration in which only the CPU 51 or the storage 52 is an external device is also conceivable.

Note that there may also be multiple dedicated controllers for controlling the conveyor 2, detector 3, and eraser 4.

In this embodiment, the controller 5 is dedicated to the sheet processing device 1, and separate controllers are provided for the shredder 12 to sheet forming device 20, but the invention is not so limited. For example, the controllers of devices from the shredder 12 to the sheet forming device 20 may also be configured to control other parts of the sheet processing device 1, and the controller 5 may control devices from the shredder 12 to the sheet forming device 20 in addition to controlling parts of the sheet processing device 1.

The CPU 51 executes programs stored in storage 52. The CPU 51 functions as a data processor that processes image data captured by the camera 31. As described above, the CPU 51 also identifies the printed part P and defines the printed area PA.

The detector 3 has a camera 31 (imaging unit) that images the feedstock M0 (sheet), and the controller 5 has a CPU 51 that functions as a data processor that processes image data captured by the camera 31 (imaging unit). This enables identifying the printed part P and defining the printed area PA.

The storage 52 in this example is rewritable nonvolatile memory. Programs such as programs related to sheet processing as described above are stored in storage 52, and the programs are run by the CPU 51.

A control operation of the controller 5 of the sheet processing device 1 is described next with reference to the flow chart in FIG. 9.

Sheet processing starts in step S101. In other words, the conveyor 2 and brush 41 are operated.

Next, the supplied and conveyed feedstock M0 is imaged (step S102). Note that when the feedstock M0 is supplied by a feeding device not shown, the timing of detector 3 (camera 31) operation, that is, imaging, may be adjusted to the conveyance speed of the conveyor 2, or the timing of imaging may be adjusted by a timer based on calculating the time required for the feedstock M0 to be conveyed to the imaging area.

Next, in step S103, the printed part P is detected in the image acquired in step S102 (printed part detection process). For example, the image may be divided into specific areas, and when the brightness in each area is less than or equal to a specific threshold, the controller 5 may decide color material CM was detected, but if the brightness is greater than the specific threshold, decide there is no color material CM. The printed part P can be determined based on this information.

Next, in step S104, the controller 5 defines the printed area PA containing the printed part P identified in step S103 (see FIG. 8).

Next, in step S105, the short rollers 431 to drive are selected from the roller group 43. This selected is made based, for example, on information such as the number of printed areas PA, the location, and the size of the printed areas PA in the image.

The short rollers 431 selected in step S105 are then driven to selectively remove the printed areas PA (step S106). Note that the timing for driving the short rollers 431 is calculated based on the conveyance speed of the feedstock M0 and the distance from the detector 3 to the eraser 4, for example.

The time that the short rollers 431 are pressed against the feedstock M0 can also be calculated based on the length of the printed area PA in the conveyance direction and the conveyance speed, for example.

As described above, the sheet processing device 1 moves the short rollers 431 toward the brush 41 timed to when the printed area PA on the feedstock M0 passes between the brush 41 and short rollers 431, raising the feedstock M1 with the glue belt 210 and pushing the printed area PA in contact with the brush 41. This increases the contact pressure between the printed area PA on the feedstock M0 and the brush 41, and the surface part of the printed area PA is ground. As a result, the printed part P, that is, the color material CM, is removed without excess or deficiency from the feedstock M0. More specifically, because grinding of areas outside the printed area PA is prevented, the amount of fiber supplied as feedstock M1 to the downstream sheet manufacturing apparatus 100 can be increased as much as possible. Sheets S can therefore be manufactured with good yield.

Embodiment 2

Figure 10:
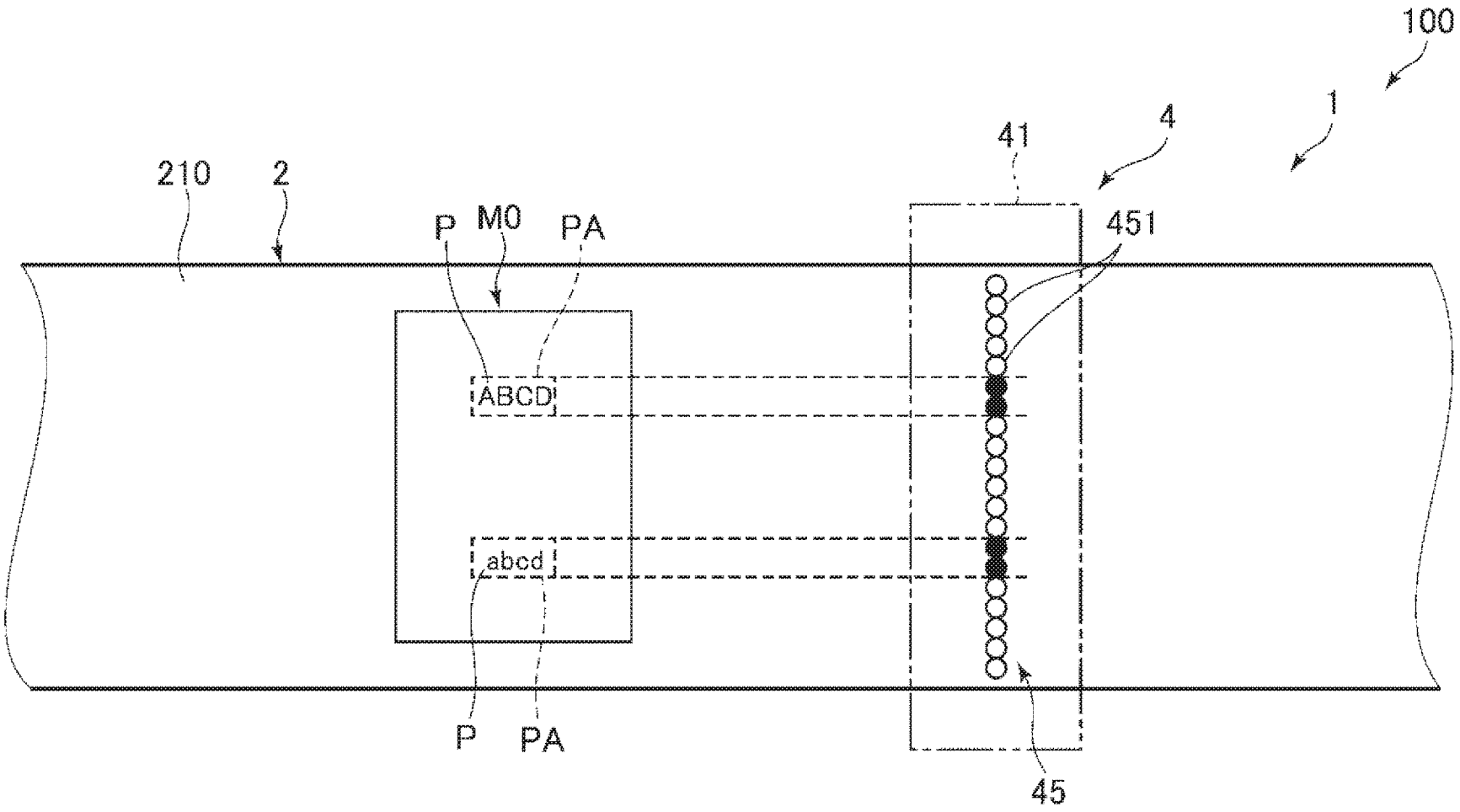
FIG. 10 is a top view illustrating the configuration of a sheet processing device according to the invention disposed to the upstream side of a sheet manufacturing apparatus according to a second embodiment of the invention.
Figure 11:
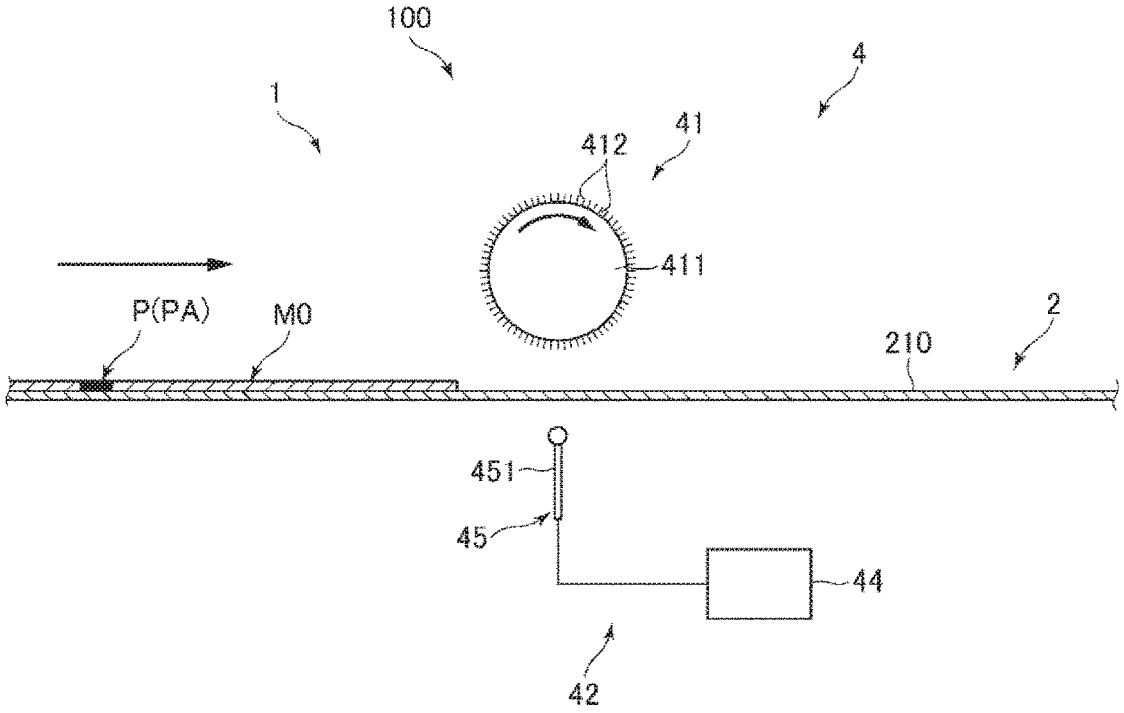
FIG. 11 is a schematic side view of the sheet processing device shown in FIG. 10.
Figure 12:
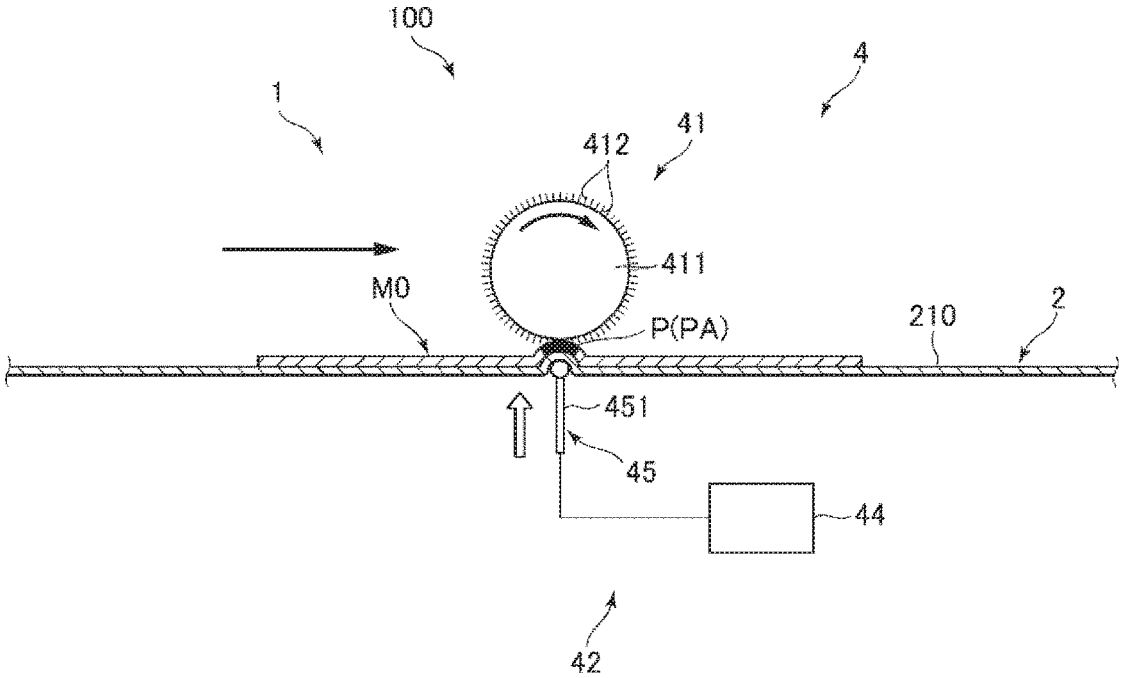
FIG. 12 is a schematic side view of the sheet processing device shown in FIG. 10.

FIG. 10 is a top view illustrating the configuration of a sheet processing device according to the invention disposed to the upstream side of a sheet manufacturing apparatus according to a second embodiment of the invention. FIG. 11 is a schematic side view of the sheet processing device shown in FIG. 10. FIG. 12 is a schematic side view of the sheet processing device shown in FIG. 10.

A second embodiment of a sheet processing device according to the invention is described below with reference to the accompanying figures, focusing on the differences between this and the foregoing embodiment, and omitting or simplifying further description of like elements.

This embodiment is the same as the first embodiment except for the configuration of the pressure member.

As shown in FIG. 10, the eraser 4 has a dot impact head 45 (pressure elements). The dot impact head 45 is disposed to a position opposite the brush 41 with the glue belt 210 therebetween, and its position in the conveyance direction of the feedstock M0 is the same as the brush 41.

The dot impact head 45 has multiple (17 in this example) pressure pins (pins) 451 disposed across the width of the glue belt 210, that is, in a direction intersecting the conveyance direction of the feedstock M0.

As shown in FIG. 11 and FIG. 12, the pressure pins 451 are disposed substantially perpendicularly across the width of the glue belt 210 (across the width of the feedstock M0 being conveyed). The pressure pins 451 are connected to the drive source 44, and configured to move to and away from the brush 41 by driving the drive source 44.

The distal ends of the pressure pins 451, that is, the ends on the glue belt 210 side, are rounded. As a result, damage to the glue belt 210 when the pressure pins 451 push the glue belt 210 can be prevented.

As shown in FIG. 11, when the area outside the printed area PA of the feedstock M0 (that is, white space) passes between the brush 41 and pressure pins 451, the pressure pins 451 do not operate. Timed to when the printed area PA of the feedstock M0 passes between the brush 41 and pressure pins 451, selected pressure pins 451 move toward the brush 41 and push the glue belt 210 and feedstock M1 up, causing the printed area PA to contact the brush 41. Note that in this embodiment only the pressure pins 451 of the dot impact head 45 aligned with the printed area PA, that is, the pressure pins 451 indicated by the black dots in FIG. 10, operate.

As a result, contact pressure between the brush 41 and the printed area PA of the feedstock M0 increases, the surface part of the printed area PA is abraded, and the printed part P, that is, the color material CM, is removed from the feedstock M0.

Because the pressure pins 451 are relatively small, even relatively small printed areas PA can be precisely removed. For example, the printed area PA can be set to the printed part P alone. In this case, the controller 5 preferably inverts the shape of the printed part P and drives only those pressure pins 451 corresponding to the specific areas of the inverted shape.

Embodiment 3

Figure 13:
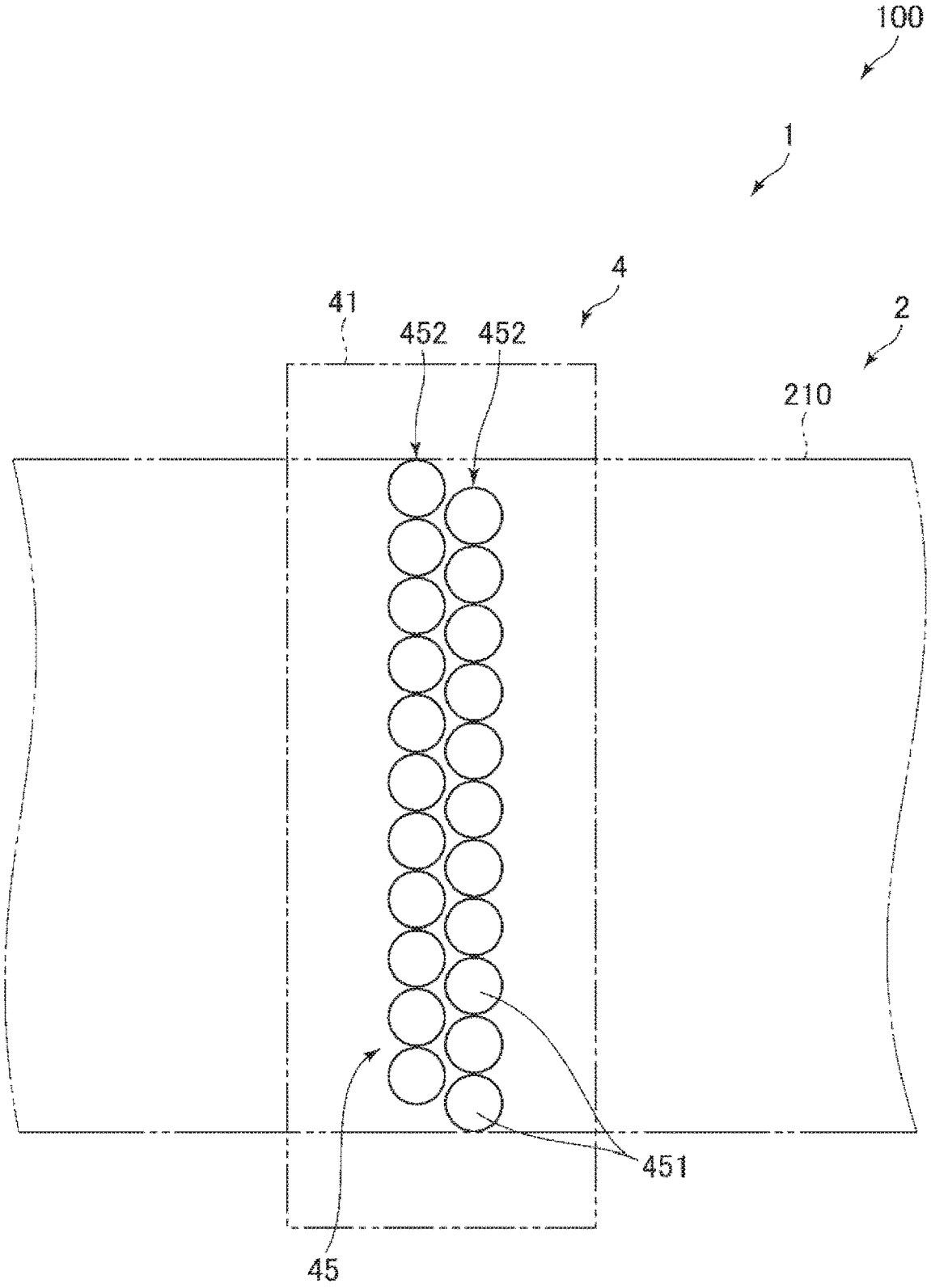
FIG. 13 is a top view illustrating the configuration of a sheet processing device according to the invention disposed to the upstream side of a sheet manufacturing apparatus according to a third embodiment of the invention.

FIG. 13 is a top view illustrating the configuration of a sheet processing device according to the invention disposed to the upstream side of a sheet manufacturing apparatus according to a third embodiment of the invention.

A third embodiment of a sheet manufacturing apparatus according to the invention is described below with reference to the accompanying figures, focusing on the differences between this and the foregoing embodiments, and omitting or simplifying further description of like elements.

This embodiment is the same as the second embodiment except for the arrangement of the pressure elements.

As shown in FIG. 13, the dot impact head 45 in this embodiment has two rows 452 of pressure pins 451 extending across the width of the glue belt 210 side by side in the conveyance direction. The pressure pins 451 in each row 452 are offset from each other across the width of the glue belt 210.

This configuration enables reducing the pitch between the pressure pins 451 as seen from the conveyance direction of the feedstock M0 without reducing the diameter of the pressure pins 451. As a result, even smaller printed areas PA can be removed with good precision.

Note that this embodiment has two rows 452 of pressure pins 451, but the invention is not so limited and there may be three or more rows.

Embodiment 4

Figure 14:
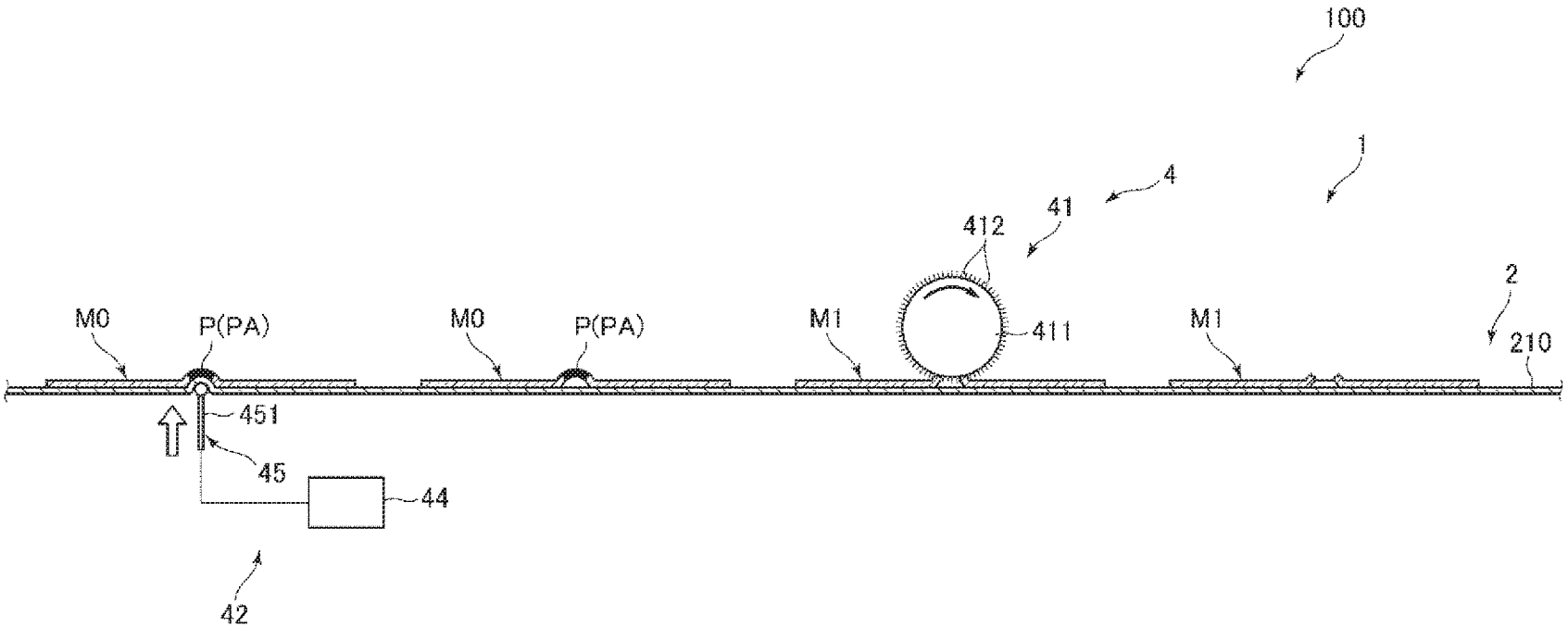
FIG. 14 is a top view illustrating the configuration of a sheet processing device according to the invention disposed to the upstream side of a sheet manufacturing apparatus according to a fourth embodiment of the invention.

FIG. 14 is a top view illustrating the configuration of a sheet processing device according to the invention disposed to the upstream side of a sheet manufacturing apparatus according to a fourth embodiment of the invention.

A fourth embodiment of a sheet manufacturing apparatus according to the invention is described below with reference to the accompanying figures, focusing on the differences between this and the foregoing embodiments, and omitting or simplifying further description of like elements.

This embodiment is the same as the first embodiment except for the configuration of the eraser.

As shown in FIG. 14, the dot impact head 45 and the brush 41 in this embodiment are offset from each other in the conveyance direction of the feedstock M0, and the dot impact head 45 is located upstream from the brush 41.

The dot impact head 45 (pressure member) applies pressure to upwardly deform the printed area PA of the feedstock M0 (sheet) before the brush 41 (grinding tool) grinds the printed area PA. The feedstock M0 with upward deformations is then conveyed downstream, and only these upwardly protruding parts, that is, only the printed area PA, are ground. As a result, grinding areas other than the printed area PA can be more effectively prevented, and the amount of fiber supplied as feedstock M1 to the downstream sheet manufacturing apparatus 100 can be increased. Sheets S can therefore be manufactured with good yield.

Embodiment 5

Figure 15:
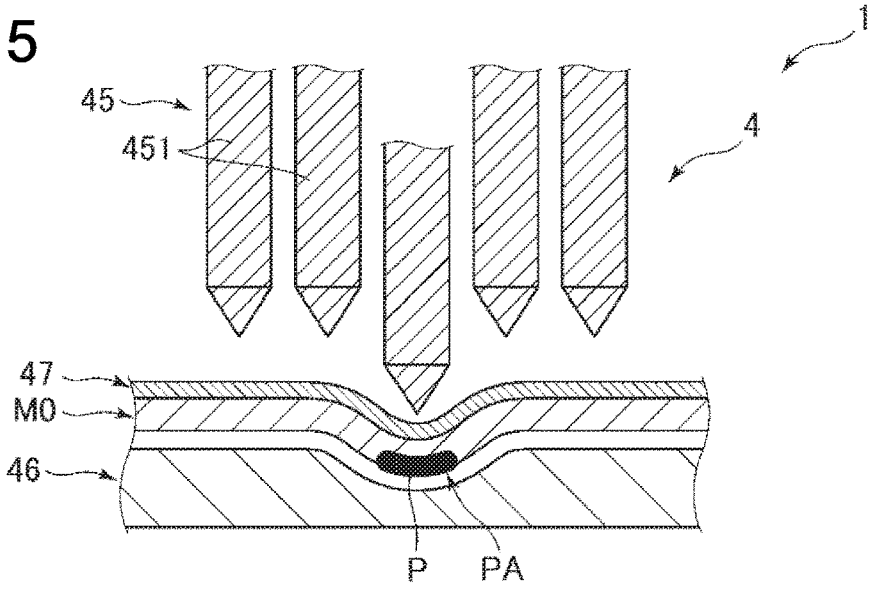
FIG. 15 is a side view of a pressure member of a sheet processing device according to the invention disposed to the upstream side of a sheet manufacturing apparatus according to a fifth embodiment of the invention.
Figure 16:
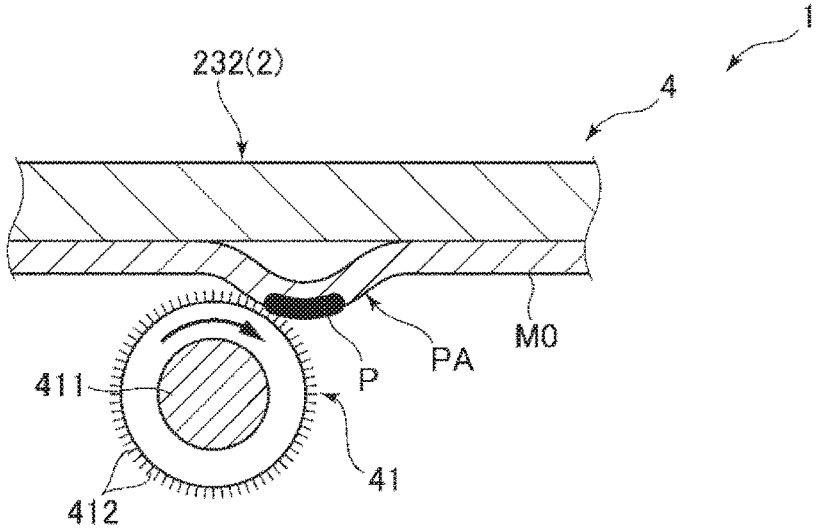
FIG. 16 is a side view of the conveyor and grinding tool of the sheet processing device shown in FIG. 15.

FIG. 15 is a side view of a pressure member of a sheet processing device according to the invention disposed to the upstream side of a sheet manufacturing apparatus according to a fifth embodiment of the invention. FIG. 16 is a side view of the conveyor and grinding tool of the sheet processing device shown in FIG. 15.

A fifth embodiment of a sheet manufacturing apparatus according to the invention is described below with reference to the accompanying figures, focusing on the differences between this and the foregoing embodiments, and omitting or simplifying further description of like elements.

This embodiment is the same as the first embodiment except for the configuration of the eraser and conveyor.

As shown in FIG. 15, the distal ends of the pressure pins 451 of the dot impact head 45 in this embodiment are pointed. As a result, pressure can be precisely applied to the printed area PA even when the printed area PA is small or has a complicated shape.

A flexible platen 46 is disposed to a position opposite the dot impact head 45 in the sheet processing device 1 according to this embodiment. When the pressure pins 451 apply pressure to the feedstock M0, the platen 46 deforms with the printed area PA of the feedstock M0, and supports the parts outside the printed area PA of the feedstock M0. As a result, the printed area PA can be more reliably deformed, and unintentional deformation of parts outside the printed area PA can be prevented.

As shown in FIG. 15, this embodiment disposes a flexible protective sheet 47 between the feedstock M0 and the pressure pins 451 when the pressure pins 451 apply pressure to the feedstock M0. Unintentionally damaging the feedstock M0 can thereby be prevented.

After the printed area PA is deformed, the printed area PA is held to a conveyor platen 230 (conveyor 2) as shown in FIG. 16, and the printed area PA is pushed against the brush 41. As a result, contact pressure can be increased only in the printed area PA, and the printed area PA can be removed.

This fifth embodiment thus has the same effect as the other embodiments described above.

Embodiment 6

Figure 17:
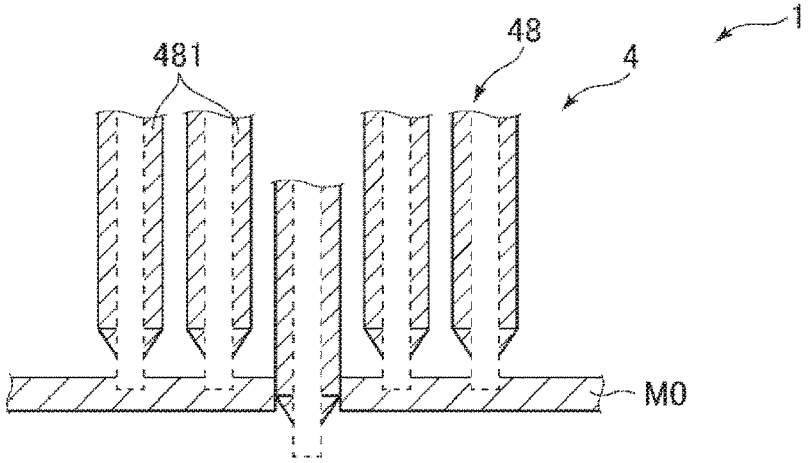
FIG. 17 is a section view of the eraser of the sheet processing device disposed to the upstream side of a sheet manufacturing apparatus according to the sixth embodiment of the invention.

FIG. 17 is a section view of the eraser of the sheet processing device disposed to the upstream side of a sheet manufacturing apparatus according to the sixth embodiment of the invention.

A sixth embodiment of a sheet manufacturing apparatus according to the invention is described below with reference to the accompanying figures, focusing on the differences between this and the foregoing embodiments, and omitting or simplifying further description of like elements.

This embodiment is the same as the first embodiment except for the configuration of the eraser.

The eraser 4 has a stamping mechanism 48 that punches through and removes the printed area PA of the feedstock M0 (sheet). As a result, the printed area PA can be reliably removed.

The stamping mechanism 48 has multiple punches 481. The punches 481 are cylindrical and the distal ends, that is, the end that contacts the feedstock M0, forms a cutter with the outside diameter narrowing to the distal end. As a result, the printed area PA can be reliably punched and removed. Furthermore, because the punches 481 are hollow, the material removed from the feedstock M0 can be recovered.

This sixth embodiment thus has the same effect as the other embodiments described above.

Preferred embodiments of a sheet manufacturing apparatus according to the invention are described above, but the invention is not so limited. Parts of the sheet manufacturing apparatus may also replaced with equivalent configurations having the same function. Other configurations may also be added as desired.

A sheet manufacturing apparatus according to the invention may also be a combination of any two or more desirable configurations (features) of the embodiments described above.

The embodiments described above describe configurations in which the used sheets being recycled are printed on one side, but the invention is not so limited and the sheets may be printed on both sides. In this case, both sides may be processed by detecting the printed part of one side and removing the printed area, and then detecting the printed part of the other side and removing the printed area.

The foregoing embodiments also describe a continuous process of detecting the printed part of one sheet (feedstock) and removing the printed area of that sheet, then sequentially processing the next sheet (feedstock) by repeating the same steps, but the invention is not so limited. For example, a batch process of detecting the printed parts of multiple sheets (feedstock), numbering the detection results (images), and then sequentially removing the printed areas of the multiple sheets (feedstock) based on the numbering information is also conceivable.

The foregoing embodiments also describe configurations in which the pressure member moves to and away from the grinding tool, but the invention is not so limited. For example, configurations in which the grinding tool moves to and away from the sheet (feedstock) are also conceivable. In this case, a platen or other support member is preferably disposed instead of a pressure member on the opposite side of the conveyor as the grinding tool.

Yet further, pressure elements may be disposed to the grinding tool. In this case, the grinding tool may be a pliable abrasive sheet, for example, and the surface of the abrasive sheet may be made to protrude in parts by pushing the abrasive sheet by pressure elements to remove the printed area.

The entire disclosure of Japanese Patent Application No. 2017-226363, filed Nov. 24, 2017 is expressly incorporated by reference herein.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A sheet processing device comprising:

a detector configured to detect a printed part printed on a sheet; and an eraser configured to selectively remove at least a surface part of a printed area including the printed part detected by the detector, wherein:

the eraser includes a grinding tool to grind the sheet, and a pressure mechanism configured to selectively increase in the printed area contact pressure between the sheet and the grinding tool, the pressure mechanism has a pressure member disposed movably to and away from the grinding tool, and directly or indirectly applies pressure to the sheet from the opposite side of the sheet as the grinding tool, and the pressure member has multiple pressure elements, and selectively drives the pressure elements to increase contact pressure of the grinding tool to the sheet in parts.

2. The sheet processing device described in claim 1, further comprising:

a conveyor configured to convey the sheet by a conveyor belt at least between the detector and the eraser;

the pressure member pressing the sheet to the grinding tool through the conveyor belt.

3. The sheet processing device described in claim 1, wherein:

the multiple pressure elements are disposed in a direction intersecting the conveyance direction of the sheet in the eraser.

4. The sheet processing device described in claim 1, wherein:

the pressure elements are rollers or pins.

5. The sheet processing device described in claim 1, wherein:

the pressure member presses and deforms the sheet to protrude in the printed area before the grinding tool grinds the printed area.

6. The sheet processing device described in claim 1, further comprising:

a controller configured to control operation of the eraser based on a detection result from the detector.

7. The sheet processing device described in claim 6, wherein:

the detector has an imager to image the sheet; and the controller has a data processor configured to process image data captured by the imager.

8. The sheet processing device described in claim 1, wherein:

the eraser has a stamping mechanism configured to punch through and remove the printed area of the sheet.

9. A sheet manufacturing apparatus comprising the sheet processing device described in claim 1.

10. The sheet manufacturing apparatus described in claim 9, further comprising:

a defibrator configured to defibrate a processed sheet of which at least a surface part of the printed area of the sheet was removed by the sheet processing device;

the sheet manufacturing apparatus producing recycled paper using defibrated material acquired by the defibrator.

* * * * *